US010856720B2

(12) United States Patent
Jolly

(10) Patent No.: US 10,856,720 B2
(45) Date of Patent: Dec. 8, 2020

(54) IN BASIN CLEANING APPARATUS

(71) Applicant: Zachary D. Jolly, Fenton, MI (US)

(72) Inventor: Zachary D. Jolly, Fenton, MI (US)

( * ) Notice: Subject to any disclaimer, the term of this patent is extended or adjusted under 35 U.S.C. 154(b) by 0 days.

(21) Appl. No.: 15/952,811

(22) Filed: Apr. 13, 2018

(65) Prior Publication Data

US 2018/0296062 A1 Oct. 18, 2018

Related U.S. Application Data

(60) Provisional application No. 62/485,053, filed on Apr. 13, 2017.

(51) Int. Cl.

| | |
|---|---|
| ***A47L 17/00*** | (2006.01) |
| ***A47L 17/04*** | (2006.01) |
| ***A46B 1/00*** | (2006.01) |

(52) U.S. Cl.

CPC ..... *A47L 17/00* (2013.01); *A46B 1/00* (2013.01); *A47L 17/04* (2013.01)

(58) Field of Classification Search

CPC ..... A47L 17/00; A47L 17/04; A47L 15/0068; A47L 15/37; A46B 9/026; A46B 9/028; A46B 15/0097; A46B 2200/3006; A46B 2200/3013

See application file for complete search history.

(56) References Cited

U.S. PATENT DOCUMENTS

| | | | | |
|---|---|---|---|---|
| 2,837,755 A * | 6/1958 | Jones | A46B 9/02 15/106 |
| 4,890,348 A * | 1/1990 | Racioppi | A45D 27/46 15/160 |
| 5,727,275 A * | 3/1998 | Rocha | A47L 15/0068 15/104.92 |
| 2012/0067371 A1* | 3/2012 | Schaaper | A47L 17/00 134/8 |
| 2014/0173839 A1* | 6/2014 | Henderson | A46D 3/00 15/22.1 |

* cited by examiner

*Primary Examiner* — Mikhail Kornakov
*Assistant Examiner* — Natasha N Campbell
(74) *Attorney, Agent, or Firm* — Zachary W. Behler; Foster Swift Collins & Smith PC

(57) ABSTRACT

The inventive in basin cleaning apparatus comprises a body with an outer cleaning surface and a cleaning slot, a base, and bristles attached to the body which is particularly useful for cleaning dishes.

3 Claims, 3 Drawing Sheets

IN BASIN CLEANING APPARATUS

CROSS REFERENCE TO RELATED APPLICATIONS

This application claims priority to U.S. provisional application Ser. No. 62/485,053, entitled "In Basin Cleaning Apparatus," filed Apr. 13, 2017.

FIELD OF INVENTION

The present invention is in the field of apparatus for cleaning objects such as dishes. More particularly, the present invention relates to an in basin cleaning apparatus particularly useful for cleaning dishes.

BACKGROUND

Many people prewash their dishes, utensils and glassware before placing it in the dishwasher. Prewashing involves the removal of leftover food, bones, toothpicks and other hard items from the dishes. It may also involve removal of labels from containers before washing. Prewashing insures a better outcome when the dishes are run through the dishwasher. Traditionally, prewashing has been done using soap and water in the kitchen sink. Various hand held scrubbing devices have also been employed. However, these methods of prewashing involve a large amount of effort to remove debris and require the use of both hands. Thus the inventor has invented an in basin cleaning apparatus that effectively prewashes bowls, plates, forks, knives, spoons, and other utensils in a faster and more efficient manner.

DESCRIPTION

Figure 1:
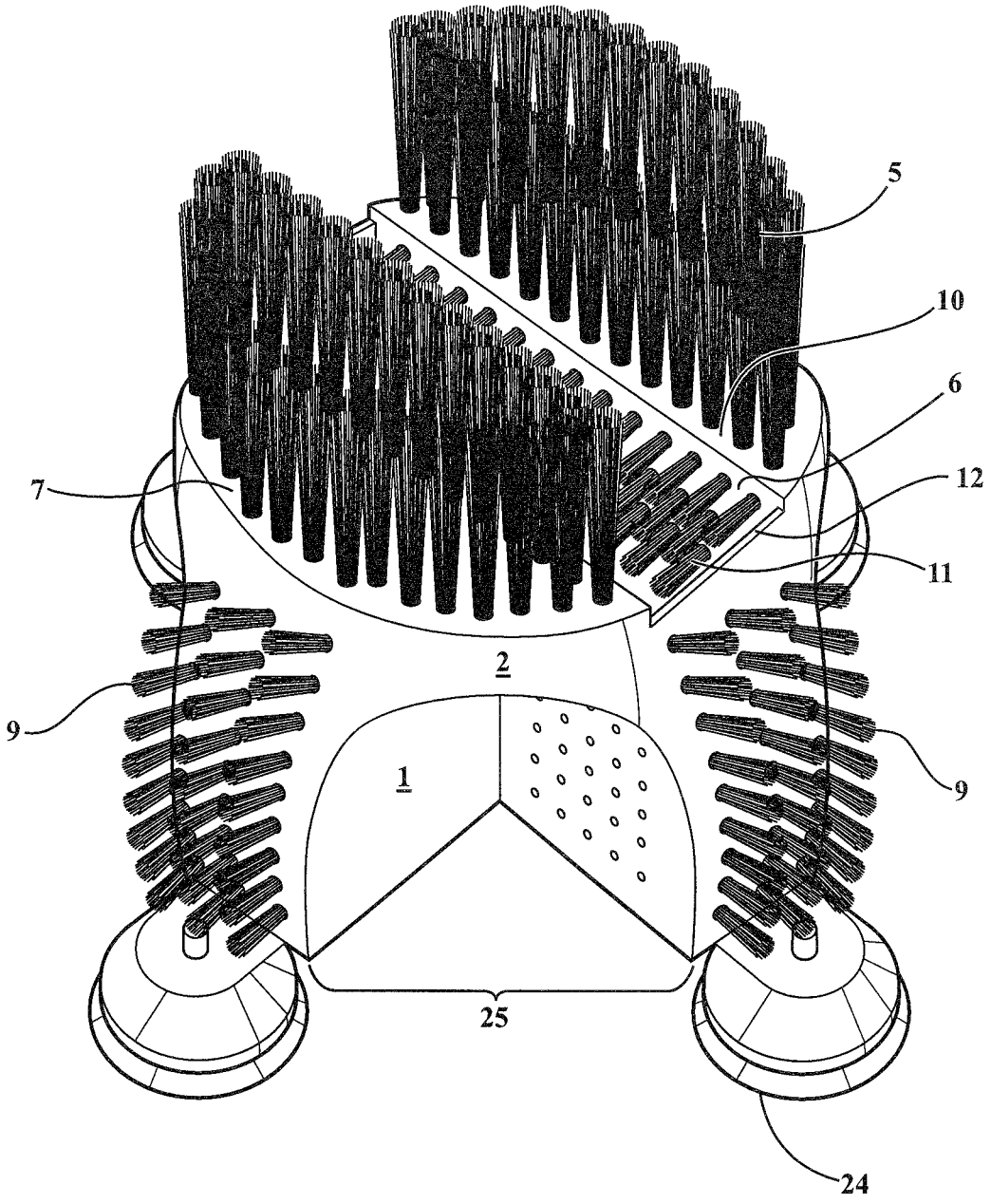
FIG. 1 is a perspective view of the top of an embodiment of the inventive basin cleaning apparatus.
Figure 2:
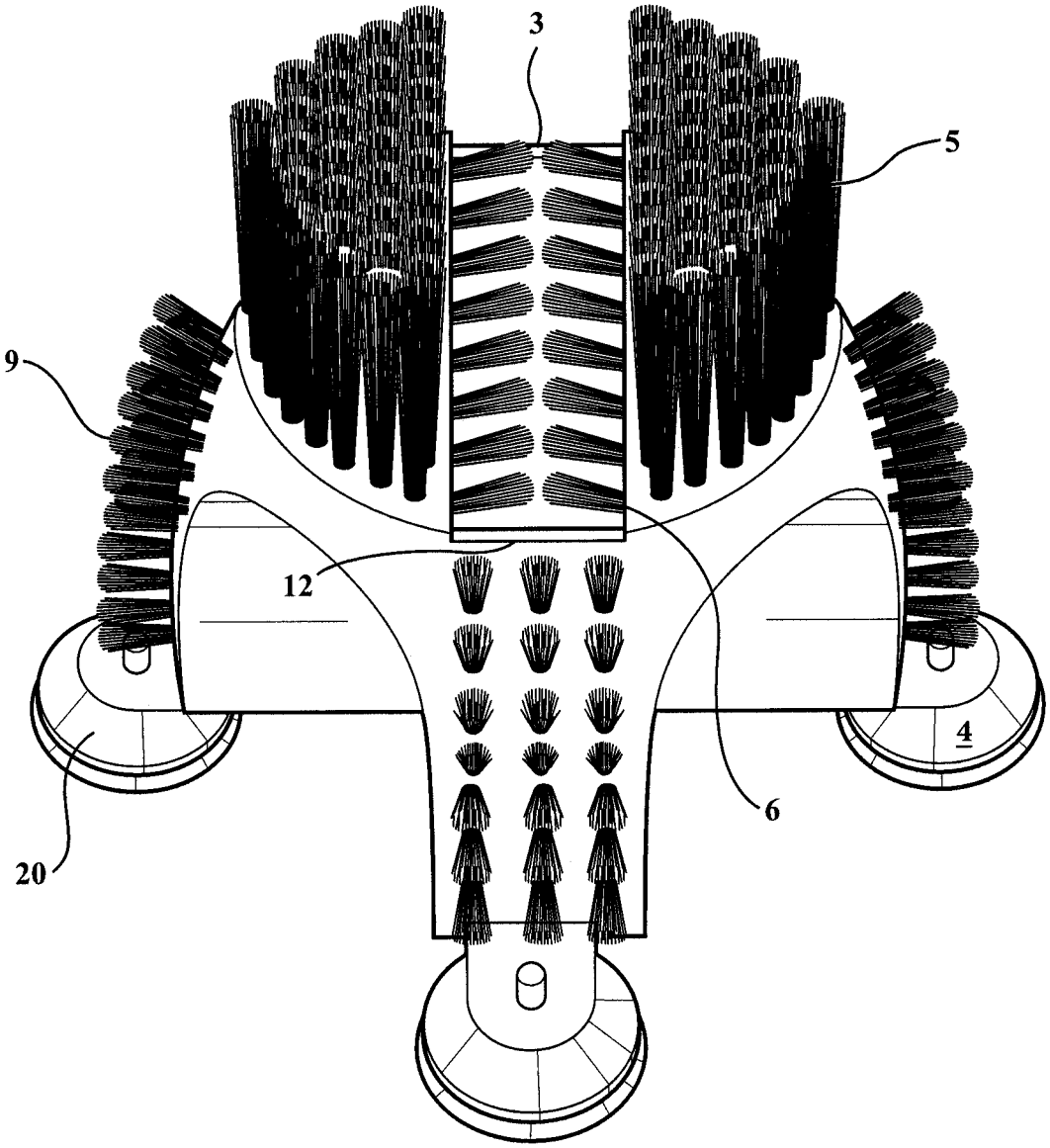
FIG. 2 is a perspective view of the top of an embodiment of the inventive basin cleaning apparatus.
Figure 3:
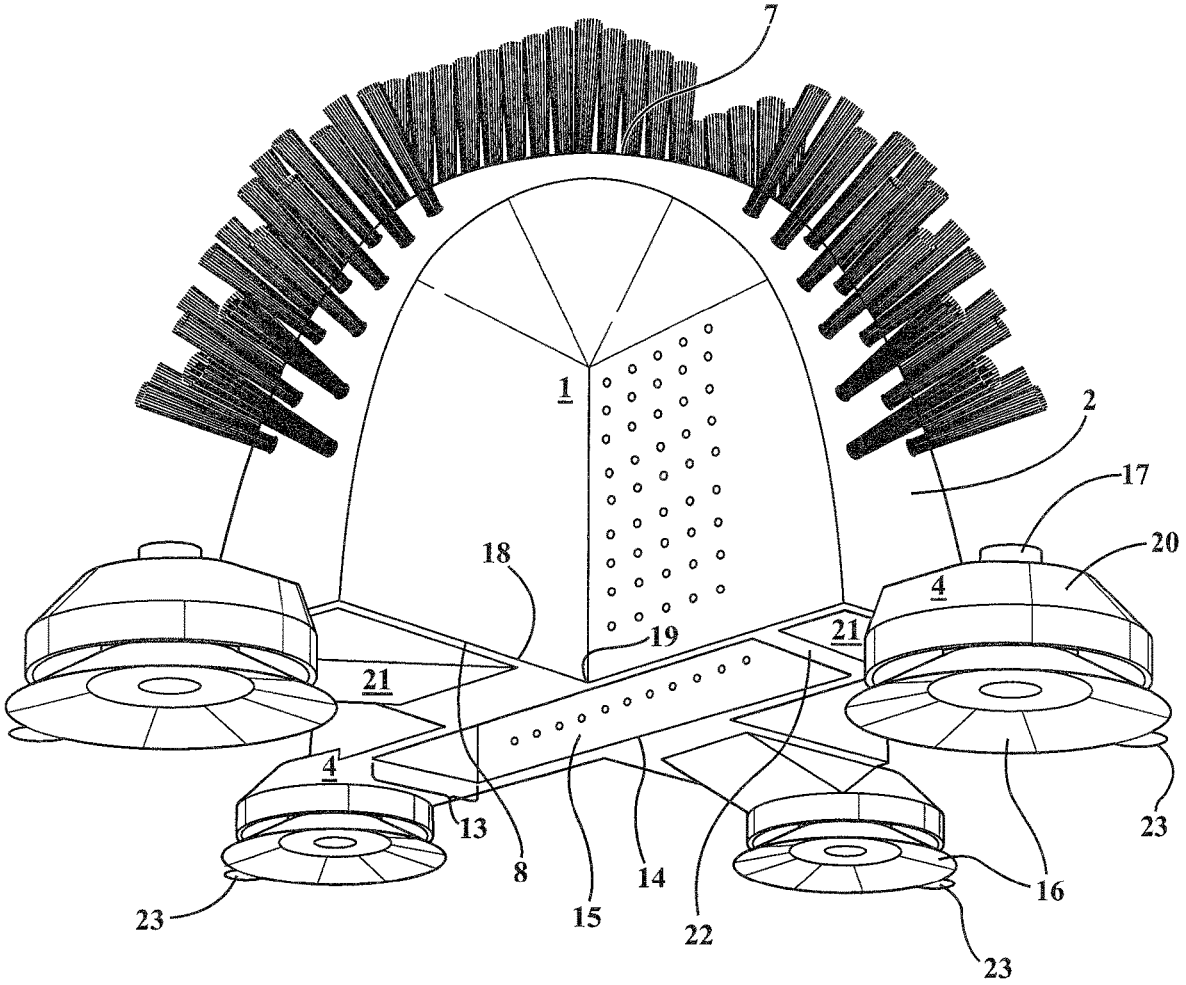
FIG. 3 is a perspective view of the bottom of an embodiment of the inventive basin cleaning apparatus.

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

The Applicant's invention consists of a body 1 comprising an outer cleaning surface 2, a cleaning slot 3, a base 4, and bristles 5 attached to the body 1. The body 1 can be constructed in a single piece or can be constructed of multiple pieces fixed together to from a single body 1. In embodiments where the body 1 is constructed of multiple pieces any means sufficient to attach the pieces securely can be utilized including, but not limited to welding, heat fusion, hardware, or adhesives. The body 1 of the in basin cleaning apparatus can be made of any material suitable for stabilizing the bristles 5 and withstanding moisture. These materials may include, metal, plastic, nylon, PVC, or other synthetic material. In the preferred embodiment the body 1 is constructed from dishwasher safe antimicrobial plastic. In preferred embodiments, the body 1 is substantially dome shaped to aid in cleaning objects with concavities such as bowls.

In the preferred embodiment the outer cleaning surface 2 is substantially covered with bristles 5. However, any bristle 5 configuration that is sufficient to remove debris from an object that is moved across the outer cleaning surface 2 is sufficient to practice the invention. In preferred embodiments the bristles 5 are made of antimicrobial nylon that is not prone to damage when placed in a dish washer. Preferably, bristles 5 are embedded directly in the outer surface 2 and inner surfaces 6 of the cleaning slot 3, but could also be formed into a series of brushes that attach to the outer surface 2 and the inner surface 6 of the cleaning slot 3. In some embodiments the length of the bristles 5 may vary over the outer cleaning surface 2 to increase the versatility of the in basin cleaning apparatus in cleaning objects with concavities such as bowls. In the preferred embodiment, bristles 5 located near the top of the dome 7 are longer than bristles 5 near the junction 8 of the base 4 and the outer cleaning surface 2.

In preferred embodiments, the base 4 is configured as a circle although other base configurations are possible. The circular base 4 has the added benefit of facilitating the user to move objects to be cleaned in a rotational manner to increase the speed and ease of cleaning. In preferred embodiments, the outer cleaning surface 2 extends this circular pattern to the top of the dome 7 so that circulars of smaller radii move up from the base in a domed fashion. The domed outer cleaning surface 2 has the added benefit of facilitating the user to move objects to be cleaned in a rotational manner to increase the speed and ease of cleaning. In the preferred embodiment the outer cleaning surface 2 is configured so that distance from the base 4 to the top of the dome 7 is in a 5/8 ratio with the diameter of the base 4. It has been found that this ratio is particularly advantageous in cleaning objects containing large concavities such as bowls while still remaining effective in cleaning objects that lack large concavities such as plates.

The cleaning slot 3 is preferably located near the top of the dome 7 of the in basin cleaning apparatus. In the preferred embodiment the cleaning slot 3 is shaped as a rectangle with a one to three width to length ratio. It has been found that this particularly advantageous shape is ideal for cleaning standard kitchen utensils. However, other geometric shapes suited to cleaning standard kitchen utensils could be utilized. In the preferred embodiment the inner surface 6 of the cleaning slot 3 is substantially covered with bristles 5. However, any bristle 5 configuration that is sufficient to remove debris from an object that is inserted and removed from the cleaning slot 3 is sufficient to practice the invention. In preferred embodiments, the bristles 5 on the inner surface 6 of the cleaning slot 3 are formed so that the ends 9 of the bristles 5 along the length 10 of the cleaning slot 3 extend beyond the center of the cleaning slot 3. This creates an overlap 11 of the bristles 5 within the cleaning slot 3 that increase pressure on an object inserted or removed from the cleaning slot 3 for cleaning. The cleaning slot 3 may also be tapered from its widest dimension near the top of the dome 7 to its smallest dimension 13 at the bottom 14 of the cleaning slot 3. Such tapering can be done along with width 12 of the cleaning slot 3, the length 10 of the cleaning slot 3, or both. Tapering in the cleaning slot 3 causes the bristles 5 to apply additional pressure to an object being cleaned as object is forced into the cleaning slot 3. It has been found that a particularly advantageous ratio for tapering along the length 10 of the cleaning slot 3 is a 7/8 ratio and a particularly advantageous ratio for tapering along width 12 of the cleaning slot 3 is a 5/6 ratio. In preferred embodiments, the cleaning slot 3 extends all the way from the top of the dome 7 to the base 4 to provide a larger cleaning surface and add stability to the body 1. In preferred embodiments, the bottom 14 of cleaning slot 3 contains and opening 15 to facilitate drainage.

The base 4 may include a plurality of suction cups 16 for affixing the in basin cleaning apparatus to the bottom of a basin, tub, bucket, or similar device used for containing fluids. In preferred embodiments, the base 4 includes a means 17 for attaching the plurality of suction cups 16 to the body 1. The means for attaching the plurality of suction cups 17 to the body 1 may include braces 18 that extend from the outer cleaning surface 2 inward toward the center 19 of the base 4, feet 20 that extend from the outer cleaning surface 2 outward away from the body 1, a surface 21 substantially located at the intersection of the base 1 configured to secure the plurality of suction cups 16, or a surface 22 connecting the outer cleaning surface 2 with the bottom 14 of the cleaning slot 3. Any method of attaching the means 17 for attaching the plurality of suction cups 16 to the body 1 that is sufficiently durable to withstand the rigors of cleaning can be used. Such method of attaching may include holes, pegs, slots, hardware, adhesives or a combination thereof. In the preferred embodiment, four suction cups 16 are attached to the base 4 near the junction 8 of the base 4 and the outer cleaning surface 2 and spaced equidistance from each other around the circumference of the base 4. In preferred embodiments, the plurality of suction cups 16 may include tabs 23 that aid in removal of the suction cups 16 when the in basin cleaning apparatus is in use. In the preferred embodiment the tabs 23 extend beyond the outer edge 24 of the suction cups 16 and the outer cleaning surface 2 for ease of use.

The base 4 may also include a plurality of indentations 25 that allow debris to flow under the outer cleaning surface 2 when the in basin cleaning apparatus is in use. In preferred embodiments, four indentations 25 are placed in the base 4 near the junction 8 of the base 4 and the outer cleaning surface 2 and spaced equidistance from each other around the circumference of the base 4. Placement of the indentations 25 should be such as to not interfere with the means 17 for attaching the plurality of suction cups 16 to the body 1. In preferred embodiments, the indentations 25 are three inches wide at the base 4 and rise three and a quarter inch in the center to create an arch shaped indentation.

The in basin cleaning apparatus is placed in a basin, tub, bucket, or similar device used for containing fluids when in use. Typically, the in basin cleaning apparatus is affixed to the bottom of the basin using the plurality of suction cups 16. The user may then clean a dirty object such as a plate or bowl by rubbing or twisting the object against the outer cleaning surface 2. The user may also clean a dirty object such as a utensil by inserting and removing the utensil from the cleaning slot 3. Soap and water may also be used to enhance cleaning. When the user has no more objects to clean, the in basin cleaning device may be placed in a dishwasher for cleaning.

The invention claimed is:

1. An in basin cleaning apparatus comprising:

a rigid body comprising a dome shaped outer cleaning surface to facilitate cleaning in a rotational manner substantially covered with bristles and a rectangular cleaning slot substantially covered in bristles;

a base attached to the rigid body; and a means for removably attaching the base to the inside of a device used for containing fluids.

2. The in basin cleaning apparatus of claim 1 wherein the cleaning slot is located near the top of the dome.

3. The in basin cleaning apparatus of claim 2 wherein the cleaning slot further comprises:

a widest dimension near the top of the dome;

a smallest dimension at the bottom of the cleaning slot; and tapering between the widest dimension and the smallest dimension.

* * * * *